US007464413B2

(12) United States Patent
Todd

(10) Patent No.: US 7,464,413 B2
(45) Date of Patent: Dec. 16, 2008

(54) RAPID RELEASE MECHANISM FOR TEXTILE APPAREL POCKETS (RECEPTACLES) AND PACKS (STOWAGE RECEPTACLES)

(75) Inventor: Wendy L. Todd, Solomons, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 818 days.

(21) Appl. No.: 11/001,599

(22) Filed: Nov. 30, 2004

(65) Prior Publication Data

US 2006/0112476 A1 Jun. 1, 2006

(51) Int. Cl.
*A41D 3/02* (2006.01)

(52) U.S. Cl. ..... 2/94

(58) Field of Classification Search ..... 2/94, 2/102, 69, 247–253, 79, 227, 108
See application file for complete search history.

(56) References Cited

U.S. PATENT DOCUMENTS 4,791,681 A * 12/1988 Dean ..... 2/106
5,517,696 A * 5/1996 Krugler ..... 2/250
6,154,888 A * 12/2000 Krohn ..... 2/250

* cited by examiner

*Primary Examiner*—Tejash Patel
(74) *Attorney, Agent, or Firm*—Mark O. Glut

(57) ABSTRACT

A mechanism that enables rapid release and access to contents stored at inconveniently located garment or storage receptacles is disclosed. The mechanism allows two sides of a receptacle storing contents to be opened simultaneously and rapidly with a one-handed operation, thus revealing the receptacle's interior, and releasing the contents thereof for immediate access to user.

6 Claims, 5 Drawing Sheets

RAPID RELEASE MECHANISM FOR TEXTILE APPAREL POCKETS (RECEPTACLES) AND PACKS (STOWAGE RECEPTACLES)

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention provides the mechanism whereby contents of an apparel receptacle (pocket) or a stowage receptacle (bag, pack) can be accessed or released upon via a one-handed operation of the mechanism. The present invention relates to (1) garments worn by humans, particularly to pockets designed or located such that contents stored therein are difficult to access because of the location of the opening mechanism and (2) other stowage receptacles (e.g., bags, packs, luggage, etc.) wherein quick access to content therein is hampered by an inconvenient location or requires two-handed operation of the opening mechanism.

(2) Description of the Prior Art

Textile apparel and its accessory storage items, such as bags and packs often provide the human user (hereafter termed "user") mechanisms that enable the storage of and access to ancillary items. These mechanisms include hardware clips and rings, textile loops, textile pouches, and cloth pockets. Items stored in such features can include a variety of items including personal items, tools, and, particularly for those in high-risk-of-injury occupations, survival aids.

The current invention was created from design of a special type of coverall naval aviators use called an immersion protective coverall (also known as "dry-suit" and "anti-exposure suit") that function to protect the wearer from wetting in cold seas and resultant hypothermia. A major shortcoming of conventional coveralls is the lack of a cloth pocket that provides an accessible location secure storage, while allowing quick access to the protective gloves required to be worn to survive cold water mishaps. However, the only conventional accessible pockets are hidden under a heavily laden survival vest, or are out of reach on the calf or on the thigh. Adding to the difficulty is the closure mechanism, a metal zipper that requires two hands to operate—one to move the metal slider, and the other to provide countertension that enables slider movement. Operations that require two hands should be strictly avoided in the design of survival equipment because of concomitant injuries that may disable one hand or arm of the user. Thus, although the hand protection provided by protective gloves is technically available, it is not accessible to the user. The present invention develops a rapid release mechanism to enable fast access of the pocket contents using one hand. Side benefits of the invention are abrasion protection for the elbow area underneath the pocket, and because the gloves are made of soft materials, cushioning the wearer's elbow during flight.

SUMMARY OF THE INVENTION

The primary objective of the present invention is to enable one-handed rapid release of the closure mechanism to allow access to pocket or bag contents from an inconvenient location. The mechanism enables pulling open two sides of the receptacle, be it pocket or bag and simultaneously, thus releasing contents by the use of one hand.

In accordance with the above objectives, a panel is provided that comprises the rapid release mechanism installed on a fabric panel and can represent a pocket of a garment or the access panel for a bag. The invention comprises: (a) first panel (containing the rapid release mechanism) that overlaps and attaches to a fabric panel (representing the garment or bag) having an access region, such that all edges of the first panel are in correspondence with one another, two edges being attached permanently, and the other two access edges being engaged with each other, via a reversible closure, and shaped such that these two access edges are roughly perpendicular to each other; (b) one or more thongs travel freely within a novel fabric tunnel (called a "casing") of which the pulling ends of the thongs extend beyond the mouth of the casing, and the terminal ends of the thongs are permanently attached at the first panel access edges; and (c) a gripper for the user's fingers or teeth to grasp and apply a pulling force on the thongs' pulling ends such that the terminal ends pull two panel access edges away from the access region of the fabric panel. The reversible closure apparatus includes a first and second reciprocal members releasabley engageable with each other with the first reciprocal member being attached to one of the first two access edges and the second reciprocal second member being attached to the other two access edges. The first and second reciprocal members being arranged so that when one access edge is placed on the other edge, releasable engagement occurs therebetween.

The above and other novel features and advantages of the invention, including various novel details of the construction and combination of parts, will now be more particularly described with reference to the accompanying drawings and pointed out by the claims. It will be understood that the particular devices of the different embodiments are shown and described herein by way of illustration only, and not as limitations of the invention.

BRIEF DESCRIPTION OF THE DRAWINGS

Reference is made to the accompanying drawings in which are shown different embodiments of the invention from which its novel features and advantages will be apparent to those skilled in the art and wherein.

DETAILED DESCRIPTION OF THE PREFERRED EMBODIMENTS

Figure 1:
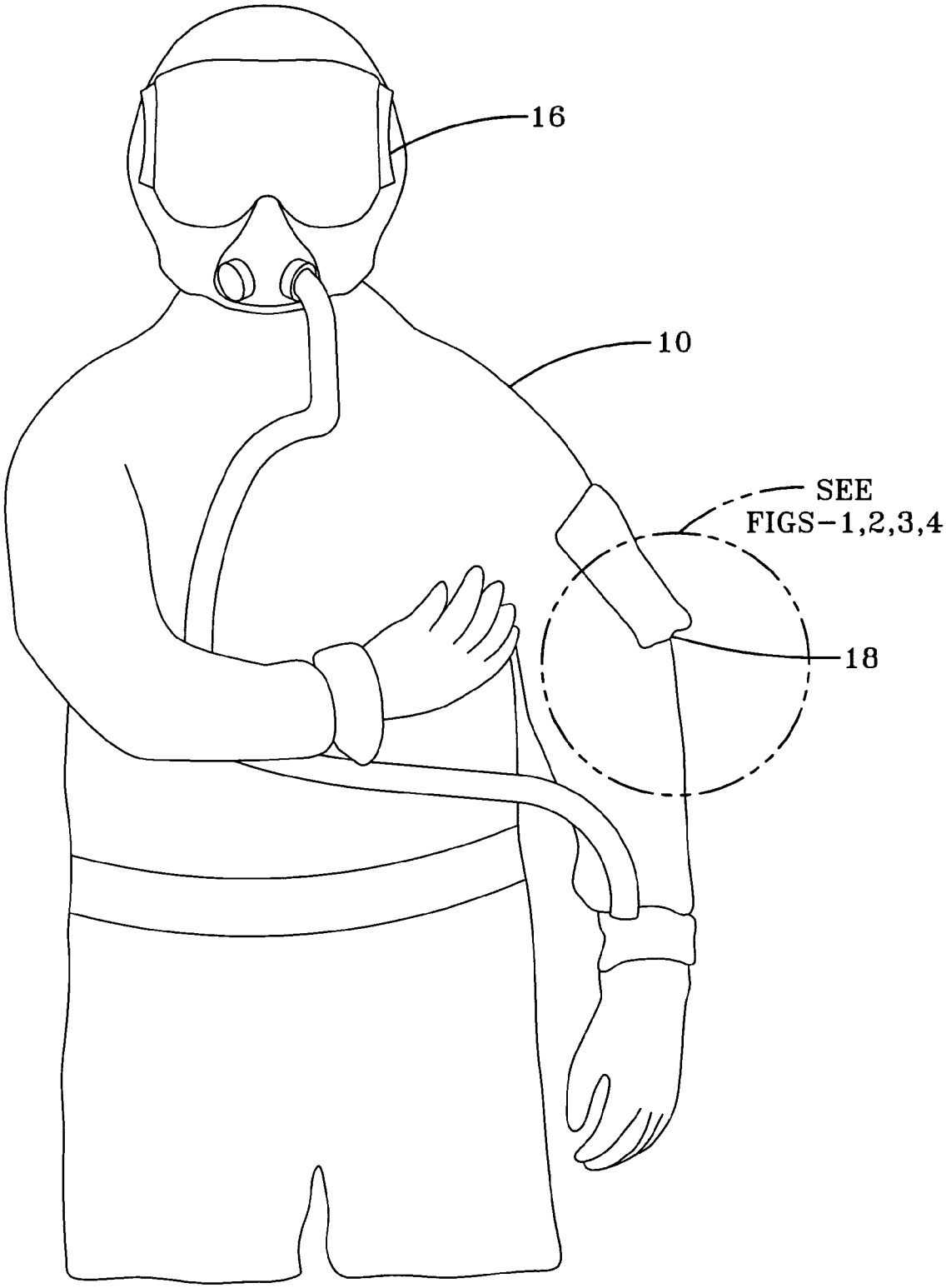
FIG. 1 illustrates an individual wearing coveralls, wherein the bulk of the flight ensemble prevents access to the backside of the elbow, providing for an inconveniently located pocket or receptacle for storage that requires the beneficial aspects of rapid release features of the present invention.

With reference to the drawings wherein the same reference number indicates the same element throughout, there is illustrated in FIG. 1 a garment 10, more particularly, coveralls 10 constructed in a conventional fashion from materials selected from the group consisting of fabrics of woven and non-woven constructions and having laminated or coated treatment. The coveralls 10 are worn by a person 12.

In general, and as to be further described, the present invention provides a fabric panel having an access region used for storing items. The rapid release mechanism includes (a) a first panel having four edges and embodying the rapid release. The first panel overlaps and attaches to the fabric panel such that all four edges of the first panel are in correspondence with each other and such that two of the four edges of the first panel are attached to the fabric panel and the other two of the four edges serve as access regions that are substantially perpendicular to each other. The two access edges are engaged with each other by a reversible closure apparatus and in alignment with the access region of the fabric panel. The rapid release mechanism further comprises (b) a casing serving as a fabric tunnel having a mouth and length so as to extend across the first panel and attach to two access edges. The rapid release mechanism further comprises (c) at least one thong that enters the mouth of the casing and travels freely within the fabric tunnel. The thong has oppositely spaced pulling and terminal ends with the terminal end attached to two access edges of the first panel and the pulling end extending beyond the mouth of the casing and (d) a gripper to provide fingers or teeth of the wearer of the fabric panel to grasp and apply a pulling force on the thongs' pulling end such that the terminal end pulls two of the first panel access edges away from the panel access regions.

The person of FIG. 1 is depicted as an individual who is unable to reach open and access the pocket or receptacle 30 with one hand. The person may represent any individual such as those in the military, whereas the coveralls 10 may be anti-exposure coveralls 10, particularly useful for those in the military. The coveralls 10 have an inconvenient location 18 whose access is enhanced by the practice of the present invention, and which may be further described with reference to FIG. 2.

Figure 2:
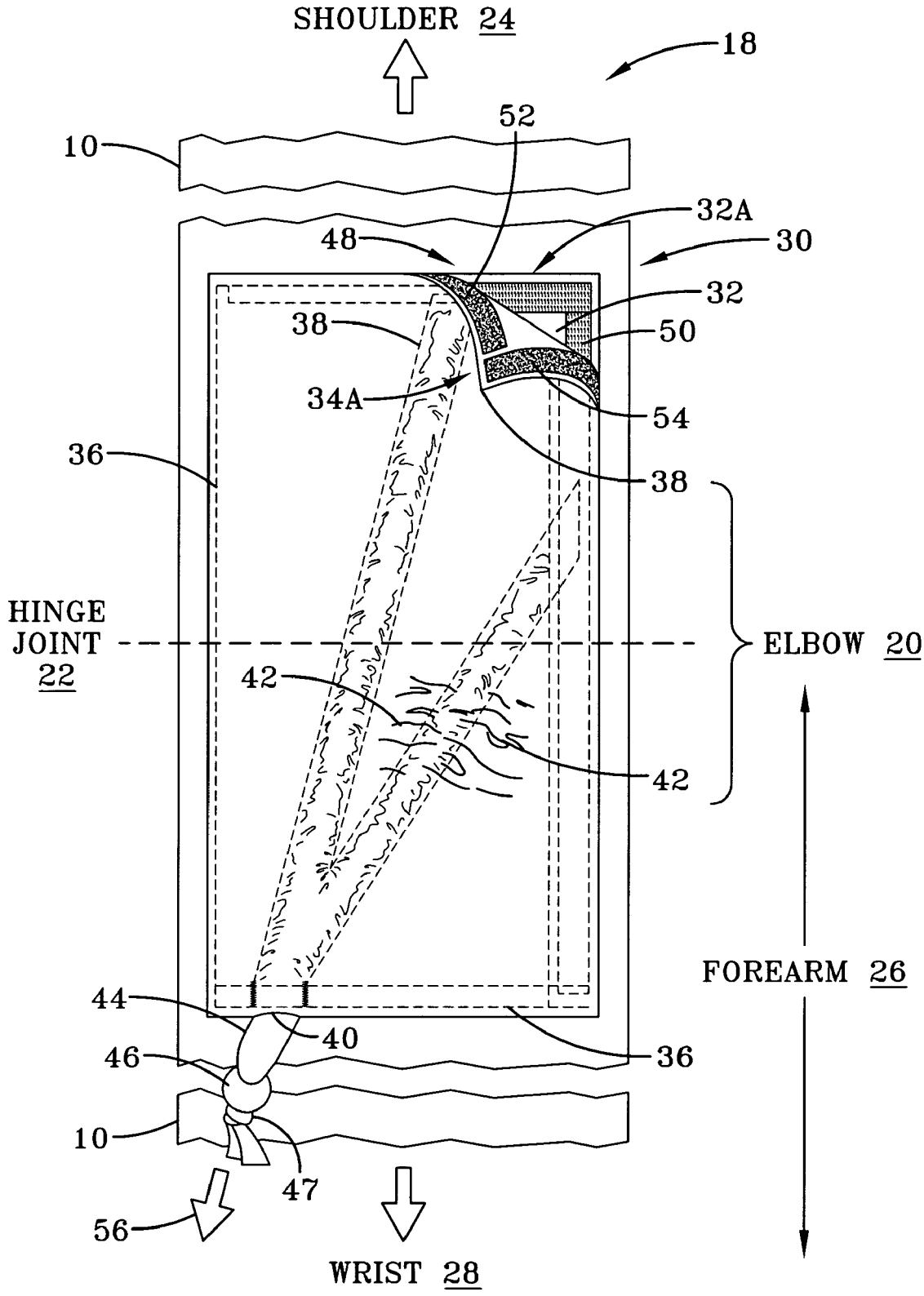
FIG. 2 illustrates one embodiment of the rapid release mechanism for storage of the present invention.

FIG. 2 illustrates the location 18 as including the section of the coveralls 10 that covers the elbow 20 of the individual (not shown) wearing the coveralls 10. As is known, the elbow 20 provides a hinged joint 22 made of the humerus, ulna and radius bones of a human. FIG. 2 illustrates the elbow 20 as being below the shoulder 24 of the individual and interconnected to the forearm 26, which is part of the arm and situated between the elbow 20 and the wrist 28.

FIG. 2 illustrates one embodiment 30, which is a receptacle for storage for the coveralls 10. As used herein, the receptacle 30 for storage or stowage is meant to include all structures commonly found on garments or used for storing personal items (keys, wallets, etc.), or small protective/survival items (headwear, handwear, first-aid, etc.), or structures carried by hand to store larger personal or survival items (poncho, lifevest, airbag, etc.) for storing items, such as gloves, keys, etc. The receptacle 30 allows ingress and egress to the stored items. However, as will be further described, the receptacle 30, as well as other embodiments of the present invention, provides rapid release of the items stored therein.

The receptacle 30 for storage comprises at least one pocket comprised of first and second sheets of material 32 and 34, respectively, that may be selected from the group of materials comprising fabrics of woven or non-woven construction and having laminated or coated treatment. In one embodiment, sheet 32 serves as a fabric panel or second panel permanently attached to the wearable garment and sheet 34 serves as a first panel, which embodies the rapid release mechanism of the present invention. The shape of the first and second sheets is a predetermined shape and may be selected from the group consisting of rectangular or rounded corner, such that the two access edges, to be further described, are roughly perpendicular to each other. Each of the sheets 32 and 34 has an access region respectively shown in FIG. 2 by reference designations 32A and 34A.

FIG. 2 illustrates the receptacle 30 for storage as having a rectangular shape, wherein the first sheet 32 is affixed to the garment 10, such as stitching. The second sheet 34 is laid over and partially attached by stitching 36 to the first sheet 32, except at least the access regions 32A and 34A and allowing the access regions 32A and 34A to be arranged in correspondence with each other. For the embodiment 30 shown in FIG. 2, as well as the embodiments of FIGS. 3, 4, and 5, it is preferred that the complete two sides of rectangular shaped sheets 32 and 34 that are merged with the access regions 32A and 34B be free of any stitching 36.

Dimensions of sheets 32 and 34 are dependent upon the intended end-use. The functional length of these sheets 32 and 34 should be nearly equivalent to the diagonal length component of the first panel 34, and no longer than necessary. The length of the pull thong 44, to be further described, directly determines the amount of arm movement required to effect separation of first panel 34 from the fabric panel 32. The dimensions of a pocket provided by receptacle 30 designed to carry gloves, for instance, may be six (6) inches in width by nine (9) inches in length which are the approximate dimensions of the glove itself preferably stowed in the pocket 30. Thus, a short jerk of the pull thong 44 releases the gloves from the pocket 30. For a contrasting example, an emergency responder's bag, the rapid release access panel provided by the first panel 34, would need to be sized large enough to enable extraction of the largest object therewithin, but not so large that the required arm pulling movement is in excess of the wearer's functional arm reach. A maximum pull thong 44 length of 12 to 15 inches extending our from under the stitching 36 is recommended.

More particularly, the fabric panel and first panel 32 and 34, respectively, are sewn together on only two sides allowing two complete sides of the receptacle 30 to be open simultaneously and rapidly in a manner to be further described hereinafter. The fabric panel 34 is preferably open-pleated along the long axis of the receptacle 30, so as to add volume to the receptacle 30.

The receptacle 30 for storage further comprises a casing 38 serving as a fabric tunnel 40 and which is attached to the first panel 34, such as stitching 42. The casing 38 is attached to the sheet 34 so as to extend into at least a portion of the second access region 34A as shown in FIG. 2. For the embodiment shown in FIG. 2, the "V" shaped casing 38 runs diagonally from the lower corner of the first panel 34 to the lateral corners of first panel 34, which includes the access region 34A.

The casing 38 contains a thong 44, serving as a gripper, that has a terminal end affixed within the fabric tunnel 40 and which has a portion that protrudes from the lower corner of the first panel 34 under the stitching 36. The thong 44 enters the mouth of the tunnel fabric 40 and travels freely therein. The thong 44 has oppositely spaced pulling and terminal ends with the terminal end attached to the access edge 34A and the pulling end extending beyond the mouth of the tunnel fabric 40. The thong 44, preferably of a doubled, narrow textile tape or webbing, may also have attached thereto an apparatus for facilitating the grasping, gripping and pulling thereof selected from the group consisting of a bead 46, and a self-knot 47 threaded through the bead 46.

The receptacle 30 for storage further comprises a reversible closure apparatus 48 comprised of at least a first and a second reciprocal members releasably engageable with each other. The first reciprocal member is shown in FIG. 2 as a pile fastening tape 50, whereas the second reciprocal member is preferably comprised of the two hook arrangements 52 and 54. The first and second members are complementary selected from each other, and in addition to the hook (52 and 54) and pile fastening tape (50), consist of the group including unlocked slide fastener chains, light duty snap tape, and basted stitches that are to be further described hereinafter with reference to FIG. 5 illustrating additional embodiments of the present invention.

In operation, the receptacle 30 for storage is closed by a hook (52 and 54) and pile fastening tape (50), along the "L" shaped region of the lateral opposite edge formed from adjacent side edges as shown in FIG. 2. The remaining sides of the rectangular receptacle 30 are stitched to the coveralls or garment 10. This configuration allows two sides of the receptacle 30 to be opened/closed to allow ingress/egress to the contents stowed therein. The user can merely grip the thong 44 or bead 46 with fingers from one hand or with teeth to peel the corner occupied by the access regions 32A and 34A down thereby providing rapid access for releasing the contents stored in receptacle 30.

It should now be appreciated that the practice of the present invention provides for the receptacle 30 that allows rapid access, via one hand to the contents being stored therein and that is inconveniently located over the elbow 20. This location, which is particularly inconvenient because it is hard to see and access, is utilized by the present invention because receptacle 30 provides rapid exposure of its contents by the user by merely gripping thong 44 with fingers of one hand or with teeth and pulling the corner of the receptacle 30 down, thereby, releasing the contents that are stored therein.

Figure 3:
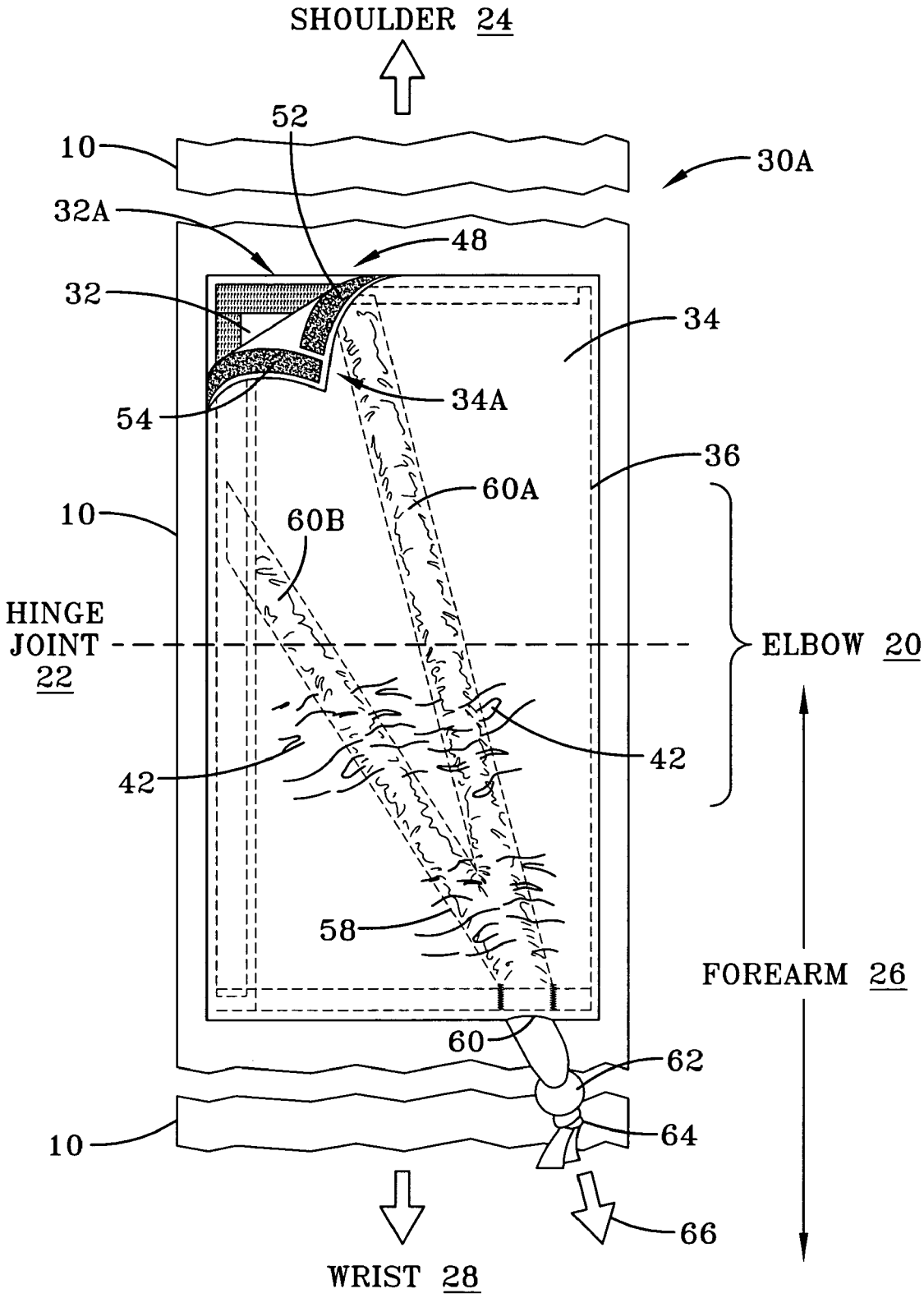
FIG. 3 illustrates another embodiment of the rapid release mechanism for storage of the present invention.

Another embodiment 30A of a receptacle for storage for a garment 10, may be further described with reference to FIG. 3. The embodiment 30A of FIG. 3 is similar to the embodiment 30 of FIG. 2, with the exception that the casing 38 and fabric tunnel 40 of FIG. 2 have been replaced with a "Y" shaped arrangement for both a casing 58 and a fabric tunnel 60. The upper portion, for example, the upper portion of the "Y" shaped fabric tunnel 60 is comprised of its upper members 60A and 60B extends into the second access region 34A. Further, the thong 44 of FIG. 2 preferably, as shown in FIG. 3, has a further gripping device comprising the pull thong 44 threaded through a plastic bead 62 and self-knotted 64 to secure the bead 62.

In operation, the embodiment 30A of FIG. 3 operates in the same manner as the embodiment 30 of FIG. 2, with the exception that the user need only pull the bead member 62 which, in turn, moves the thong 44 in the direction indicated by directional arrow 66 causing the access region 34A to be rapidly exposed and, thereby, allowing the contents retained in the receptacle 30 for storage to be rapidly accessed.

Figure 4:
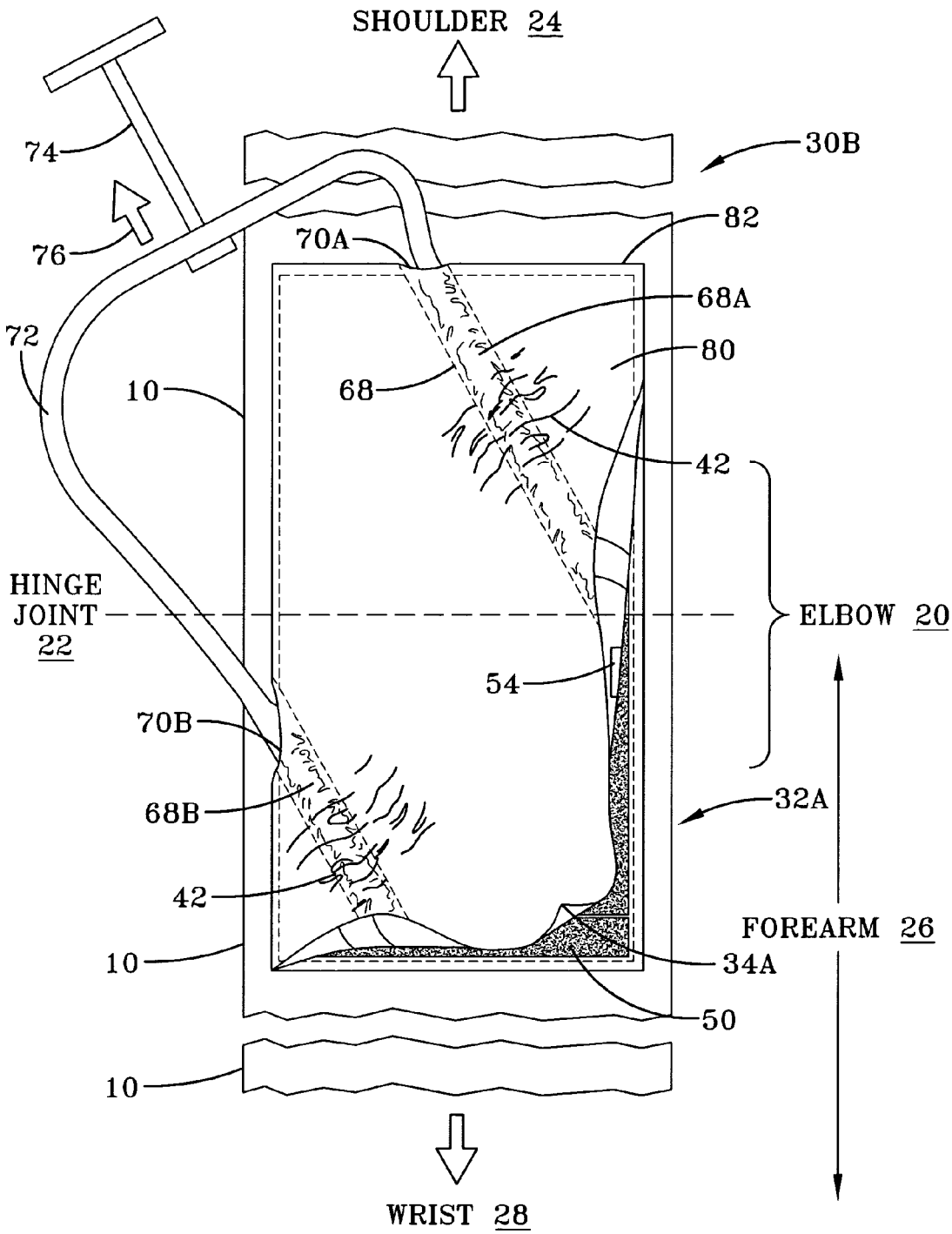
FIG. 4 illustrates yet another embodiment of the rapid release mechanism for storage of the present invention.

Another embodiment 30B of the present invention serving as a receptacle for storage, may be further described with reference to FIG. 4. The embodiment 30B of FIG. 4 is similar to the embodiment 30 of FIG. 2, with the exception that the casing 38 and fabric tunnel 40 of FIG. 2 has been replaced and two spaced apart casing 68A and 68B having associated fabric tunnels 70A and 70B, respectively. Each of the spaced apart casings 68A and 68B having fabric tunnels 70A and 70B, respectively, acts as a channel having at least a portion that extends in to the second access region 34A, with at least the second region 34A having located thereunder the pile fastening tape 50 on the first sheet 32 as shown in FIG. 4. Further, the narrow textile tape thong 44 of FIG. 2 is replaced by a "U" shaped member 72. The singe pull "U" shaped member 72 runs through the fabric tunnels 70A and 70B and thus serves a strap where it crosses from one casing 68A to the next 68B. casing 68A to the next 68B. Further, the "U" shaped member 72 can function as the thong 44, or can be attached to a different gripping device, such as the "T" shaped member 74 or any of the heretofore described gripping device. The first panel 80 of the embodiment The first panel 80 of the embodiment 30B serves as a dart, that is a stitched tapered fold. This dart replaces the pleated arranged first panel or sheet 34 of FIGS. 2 and 3, so as to increase the volume of the receptacle 30B for storage of its contents.

In operation, the embodiment of 30B of FIG. 4, works in a similar manner as that of the embodiment 30 of FIG. 2, with the exception that an operator need only pull "T" shaped member 74 causing the "U" shaped member 72 to be moved in direction 76, which simultaneously opens the access region 34A thereby exposing two sides of the receptacle 30B. This exposure is done in a rapid access manner merely by pulling on the "U" shaped member 72.

The receptacle 30B for storage of FIG. 4 has contained therein a pair of gloves, not shown, interposed between the panels 80 and 32 and being located over the elbow 20. The gloves, in combination with the panels 80 and 32, respectively, provide protection by functionally serving as an elbow pad and an abrasion pad for the individual donning the coveralls 10.

Each of the embodiments 30, 30A and 30B of FIGS. 2, 3, and 4 is shown as utilizing releasably engaging members 50, 52, and 54. However, if desired, the first and second releasably engaging members may be replaced by unlocked slide fastener chains, light duty snap tape, and basted stitches, all known in the art and respectively shown in FIGS. 5A, 5B, and 5C.

Figure 5A:
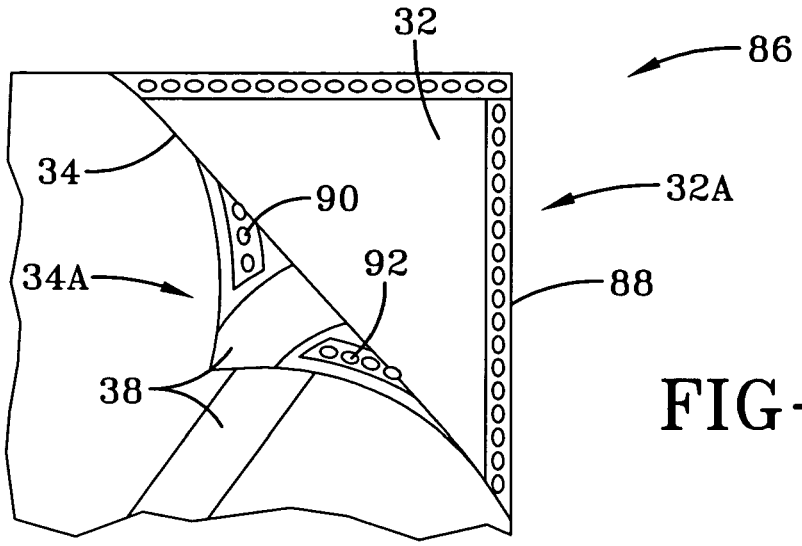
FIG. 5 is composed of FIGS. 5A, 5B, and 5C, each showing alternate embodiments of the reversible closure apparatus of the present invention.

FIG. 5A shows the unlocked slide fastener chains arrangement 86 comprised of members 88, 90, and 92 as being arranged in the access regions 32A and 34B, in a manner similar to FIGS. 2, 3, and 4.

Figure 5B:
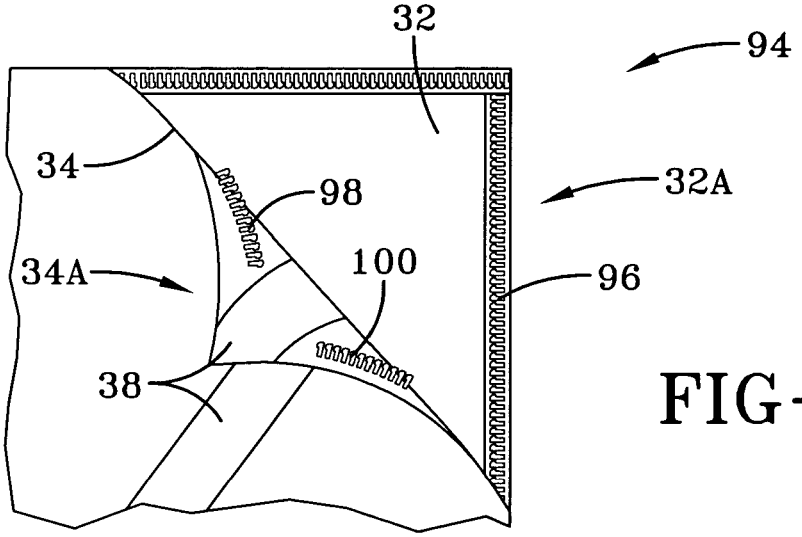

FIG. 5B illustrates the light duty snap tape in a configuration 94 and being comprised of members 96, 98, and 100 that are arranged in the access regions 32A and 34A in a manner similar to that as previously described with reference to FIGS. 2, 3, and 4.

Figure 5C:
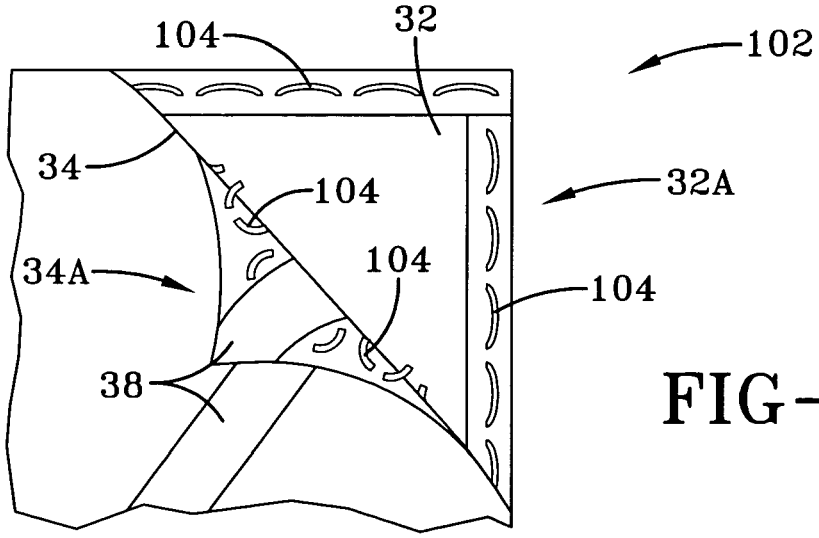

FIG. 5C shows a configuration 102 of basted stitches 104 shown in access regions 32A and 32B after the stitches 104 have been pulled apart from each other.

All of the embodiments of FIGS. 2, 3, 4, and 5, illustrate the receptacles for storage as comprised of rectangular shaped first and second sheets. However, if desired rectangular panels may be replaced by panels with rounded corners.

It should now be appreciated that the practice of the present invention provides various embodiments for a receptacle for storage of garment that is inconveniently located at the elbow region of a person donning coveralls, and yet, through the benefits of the present invention, allow two complete sides to be opened simultaneously and rapidly, thus bearing the interior of the receptacle, and releasing any contents therein for immediate access by the user.

It will be understood that various changes and details, which have been described and illustrated in order to explain the nature of the invention, may be made to those skilled in the art within the principles and scope of the invention as expressed in the amended claims.

What I claim is:

1. A rapid release mechanism for a fabric panel having an access region used for storing items, the mechanism comprising:

(a) a first panel having four edges and embodying said rapid release mechanism, said first panel overlapping and attaching to said fabric panel such that all four edges of the first panel are in correspondence with each other and such that two of the four edges are attached to said fabric panel and the other two of the four edges serving as access edges are substantially perpendicular to each other, the two access edges being engaged with each other by a reversible closure apparatus and in alignment with the access region of the fabric panel;

(b) a casing having a fabric tunnel with a mouth and a length so as to extend across said first panel and attach to said access region of said fabric panel, said fabric tunnel disposed within said front panel;

(c) at least one thong that enters said mouth and travels freely within said fabric tunnel with oppositely spaced pulling and terminal ends with the terminal end attached to two of said access edges of the first panel not in contact with said fabric panel and the pulling end extending beyond the mouth of said casing; and (d) a gripper for fingers of one-hand or teeth of the user of the fabric panel to grasp and apply a pulling force on the thongs' pulling end such that the terminal end of the thong pull the access edges of the first panel access edges in contact with the access region of the fabric panel away from the access region of the fabric panel.

2. The rapid release mechanism according to claim 1, wherein said rapid release mechanism is constructed as to be worn by a human and attached to said fabric panel so as to cover an elbow of said human, or on a pack to be carried by a human.

3. The rapid release mechanism according to claim 1, wherein said reversible closure apparatus comprises first and second reciprocal members releasabley engageable with each other with the first reciprocal member being attached to one of the access edges and the reciprocal second member being attached to the other access edge, said first and second reciprocal members being arranged so that when one of the two edges is placed on the other access edge engagement occurs therebetween.

4. The rapid release mechanism according to claim 1, wherein said first panel and fabric panel are rectangular in shape having four sides and wherein said fabric panel is partially attached to said first panel so that two of the sides of said first panel that come into contact with said access regions of said fabric panel are free to move.

5. The rapid release mechanism according to claim 2, wherein said rapid release mechanism is constructed on coveralls, or on a pack.

6. The rapid release mechanism according to claim 5, wherein said coveralls or pack is a material selected from the group consisting of fabric of woven or non-woven construction with or without laminated treatment.

* * * * *